United States Patent [19]

Lüthi

[11] 4,226,092

[45] Oct. 7, 1980

[54] DEVICE FOR COOLING HEATED TEXTILE YARNS OF THERMOPLASTIC MATERIAL

[75] Inventor: Walter Lüthi, Ebnat-kappel, Switzerland

[73] Assignee: Heberlein Maschinenfabrik AG, Wattwil, Switzerland

[21] Appl. No.: 5,853

[22] Filed: Jan. 23, 1979

[30] Foreign Application Priority Data

Jan. 25, 1978 [CH] Switzerland ..... 783/78

[51] Int. Cl.[3] ..... F25D 17/02

[52] U.S. Cl. ..... 62/374; 34/155; 62/63; 134/64 R; 134/122 R

[58] Field of Search ..... 62/63, 374; 34/155; 134/64 R, 122 R

[56] References Cited

U.S. PATENT DOCUMENTS

| | | | |
|---|---|---|---|
| 505,132 | 9/1893 | Sague | 134/64 |
| 2,259,278 | 10/1941 | Theiss | 134/122 |
| 2,625,865 | 1/1953 | Taini | 134/122 |
| 4,040,269 | 8/1977 | Nordblad et al. | 62/374 |

*Primary Examiner*—Ronald C. Capossela

*Attorney, Agent, or Firm*—Young & Thompson

[57] ABSTRACT

A device for cooling heated textile yarns derived from thermoplastic material includes a cylindrical cooling pipe (1) through which the yarn (2) is passed, the pipe (1) being filled with a cooling fluid and having a curved plate (3) inside it which covers the entire length of the pipe (1). A coaxial jacket (5) encloses the pipe and defines an annular cooling zone between the pipe and jacket. At the exit end of the pipe (1) is located a removable sealing plug which has an inlet and outlet for cooling fluid, and an air inlet. Cooling fluid and cooling air can pass into the pipe (1) via the sealing plug and circulate in the pipe and the annular zone so as to cause rapid cooling of the yarn.

3 Claims, 3 Drawing Figures

DEVICE FOR COOLING HEATED TEXTILE YARNS OF THERMOPLASTIC MATERIAL

The invention relates to a device for cooling heated textile yarns of thermoplastic material.

Processes and devices for texturing textile yarns derived from thermoplastic material on the false-twist principle are known, in which the uptwisted yarns are thermoplastified by heating and rigidified by cooling, the torque being set in the yarn during the process. Heating is provided, for example, by contacting the yarn with a hot surface and cooling is generally by passage through a zone of air at room temperature. However, it has been shown that higher yarn delivery rates necessitate relatively long air cooling zones in order to achieve a sufficient degree of cooling. For this reason, therefore, the cooling zone must be reduced by intensive cooling using special cooling devices following the heater unit.

Various types of cooling device have therefore been proposed, e.g. a pipe through which either cooled air or gas is passed at the same time as the yarn. The disadvantage of these cooling devices is that they are not capable of dealing with very high yarn-delivery rates now used on modern high-speed false twisters.

The object of the invention is to try and overcome this disadvantage and to increase the degree of efficiency of the cooling stage whereby the length of the cooling zone can be reduced to a minimum, together with the overall dimensions of the texturing machine.

Broadly stated the invention consists in a device for cooling heated textile yarns of thermoplastic material, comprising a coolant pipe or duct through which yarn can be passed lengthwise and which can receive a cooling fluid, the interior of the pipe or duct being provided with a curved member or plate extending substantially the entire length of the pipe or duct, a jacket enclosing the coolant pipe or duct and provided with a cover having a yarn inlet, a supporting member at the exit end of the coolant pipe and having a bore aligned with the coolant pipe for accommodating a removable sealing member having a yarn outlet, coolant inlet and coolant outlet, and a gas inlet connected to an inlet in the sealing member.

Preferably, the curved plate is designed to deflect the yarn from the direct flow path between the yarn inlet and outlet.

In a preferred embodiment the jacket is coaxial with the coolant pipe or duct, with uniform spacing therebetween, and the yarn inlet is concentric with the cover.

The sealing member may be in the form of a replaceable plug, and may comprise three independent elements each having a yarn outlet measuring from 0.5 to 1 mm in diameter.

The cooling device of this invention may achieve a heat transfer many times that of air cooling methods.

The invention may be performed in various ways and one embodiment will now be described by way of example with reference to the accompanying drawings, in which FIG. 1 is a longitudinal section through a cooling device;

Figure 1:
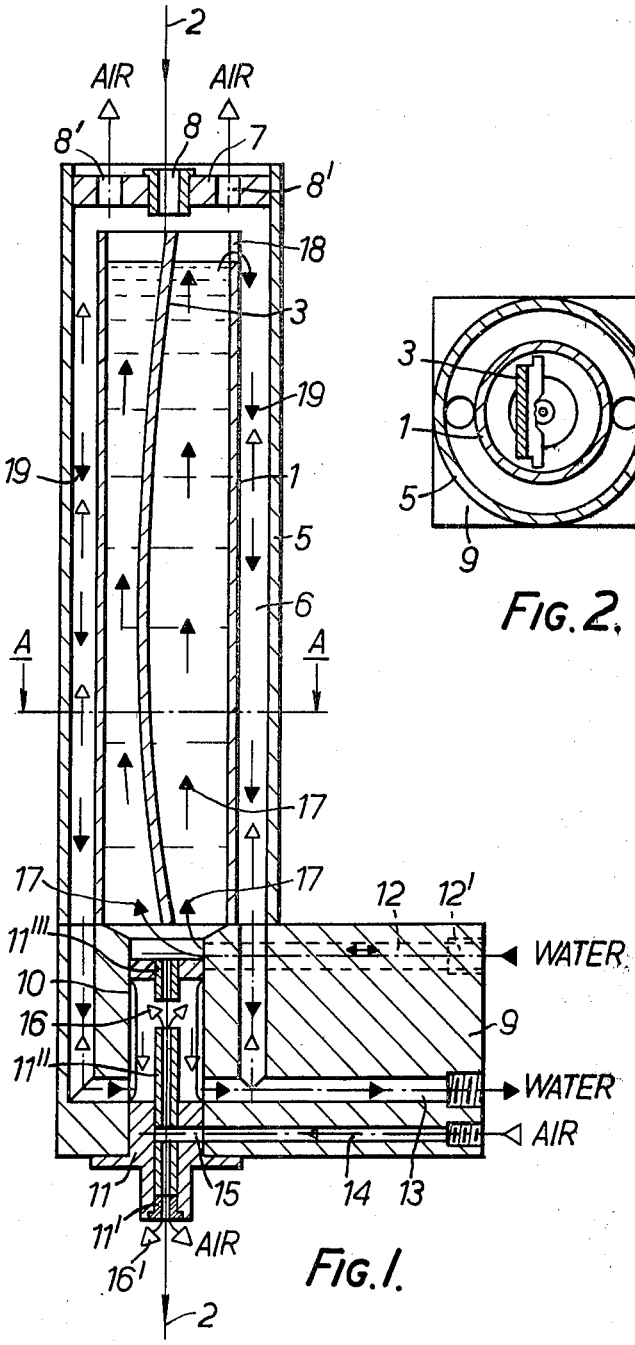
Figure 2:
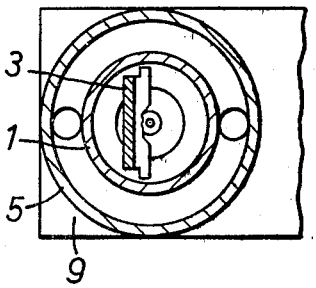
FIG. 2 is a cross-section on A—A of FIG. 1.

FIG. 1 of the drawings shows a cooling device comprising pipe 1 through which yarn 2 is passed lengthwise and which can be filled with cooling water. Fitted to the inside of the pipe 1 is a curved plate 3 extending the full length of the pipe 1 and supporting the yarn as it passes through the pipe. The pipe 1 is surrounded and enclosed by a coaxial jacket 5 having a larger diameter, thus forming an annular channel 6 between the two pipes. The jacket 5 is further provided with a cover 7 having a concentric yarn inlet 8 and a number of air outlets 8' at its entry end.

Figure 3:
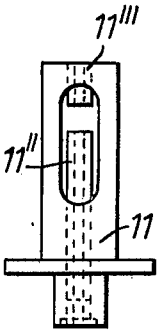
FIG. 3 is a view of a sealing plug used in the device of FIG. 1.

The exit ends of the coolant pipe 1 and the jacket 5 are connected to a supporting base 9 having a bore 10 which is coaxial with the coolant pipe 1 and contains a removable and replaceable sealing plug 11. The sealing plug 11 is represented in FIG. 3, being rotated 90° about its own axis. The sealing plug 11 comprises three independent elements 11', 11'', 11''', each being provided with a yarn outlet pointing in the direction of the axis of the coolant pipe and having a diameter of from 0.5 to 1 mm. The supporting base 9 further contains a water inlet 12, a water outlet 13 and an air inlet 14, the latter being connected to an inlet 15 in the sealing plug 11.

Before the yarn 2 is drawn through the cooling device, the sealing plug 11 is removed and the yarn to which a weight (not shown) has been attached is introduced into the empty coolant pipe 1 through the inlet 8 in the cover 7. The yarn drops to the bottom of the pipe 1 where it is caught, and the weight is removed. The yarn 2 is then drawn through the yarn outlet in the sealing plug 11 into further sections of the machine (not shown). The sealing plug 11 is replaced in the bore 10 and the machine can then be started.

As soon as the machine has reached its maximum speed, air is delivered to the sealing plug 11 from a compressed-air source (not shown) through the inlets 14 and 15, the air emerging in the direction of the arrows 16, 16'. Following this, water is allowed to enter through the inlet 12 via a water reducing valve 12', and flows into the bottom of the coolant pipe 1 in the direction of the arrows and fills it to an indentation (not shown) at point 18 where the water overflows, passing through the outlets 6 and 13 in the direction of the arrows.

The current of air emerging from the element 11'' in the sealing plug flows partly against the run of the yarn i.e. towards the top, in the direction of arrows 16, and partly with the run of the yarn towards the bottom, in the direction of arrows 16', the air pressure being selected so that no water passes through the outlet in the element 11'' during operation and no air bubbles enter the cooling water through the outlet in the element 11''' in the event of yarn breaks, which would cause the water to foam and leak through the inlets 8, 8'.

The curved plate 3 acts as a balloon breaker and prevents the introduction of intolerably large amounts of air into the water because of eddying, which would reduce and impair the stability of the cooling effect.

Should a yarn break occur or the machine be stopped, the water can be drained from the coolant pipe 1 through the outlets 12 and 13 until it has been emptied, the compressed air being switched off. Following this, the sealing plug 11 can be removed from the bore 10.

I claim:

1. A device for cooling rotating heated textile yarns of thermoplastic material, comprising a coolant pipe having a yarn inlet and a yarn outlet through which yarn can be passed lengthwise in a single run, means for passing cooling liquid into said pipe, a plate presenting a convexly curved surface to deflect the yarn from the direct flow path between the yarn inlet and yarn outlet, said plate being located in said pipe and extending substantially the entire length of said pipe, a jacket enclosing said pipe, a cover on said jacket which defines a yarn inlet, a supporting member at the exit end of said pipe which defines a bore aligned with said pipe, a removable sealing member positioned in said bore and having a yarn outlet, a coolant inlet and a coolant outlet, and a gas inlet connected to an inlet in said sealing member.

2. A device according to claim 1, in which the jacket is coaxial with the coolant pipe, with uniform spacing therebetween, and the yarn inlet is concentric with the cover.

3. A device according to claim 1, in which the sealing member is in the form of a removable plug comprising three elements each having a yarn outlet measuring from 0.5 to 1 mm in diameter.

* * * * *